US006701684B2

(12) United States Patent
Stadter

(10) Patent No.: US 6,701,684 B2
(45) Date of Patent: Mar. 9, 2004

(54) CONSTRUCTION ASSEMBLIES

(76) Inventor: Victor E. Stadter, P.O. Box 5, Rio Frio, TX (US) 78879

( * ) Notice: Subject to any disclaimer, the term of this patent is extended or adjusted under 35 U.S.C. 154(b) by 37 days.

(21) Appl. No.: 10/183,222

(22) Filed: Jun. 26, 2002

(65) Prior Publication Data

US 2004/0000111 A1 Jan. 1, 2004

(51) Int. Cl.[7] ..... E04C 1/00

(52) U.S. Cl. ..... 52/309.7; 52/309.16; 52/309.1

(58) Field of Search ..... 52/309.7, 309.16, 52/309.1, 309.3, 309.4, 309.8, 309.9, 309.11, 309.13, 309.14, 309.15, 408, 424, 425, 481.1, 747.1, 741.1, 796.1, 782.1, 783.1

(56) References Cited

U.S. PATENT DOCUMENTS 3,315,424 A * 4/1967 Smith ..... 52/206
3,484,331 A * 12/1969 Betz ..... 428/119
3,519,523 A * 7/1970 Rodman ..... 428/53
3,676,968 A * 7/1972 Campbell ..... 52/223.6
4,341,831 A * 7/1982 Kleiss ..... 428/188
4,411,939 A * 10/1983 Hawkins et al. ..... 428/58
4,674,250 A * 6/1987 Altizer ..... 52/309.7
4,813,193 A * 3/1989 Altizer ..... 52/210
4,823,534 A * 4/1989 Hebinck ..... 52/742.14
4,852,322 A * 8/1989 McDermid ..... 52/404.3
5,265,389 A * 11/1993 Mazzone et al. ..... 52/309.7
5,638,651 A * 6/1997 Ford ..... 52/309.7
5,697,196 A * 12/1997 SalahUddin ..... 52/379
5,729,942 A * 3/1998 Moore, Jr. ..... 52/437
5,758,463 A * 6/1998 Mancini, Jr. ..... 52/309.12
5,799,462 A * 9/1998 McKinney ..... 52/742.13
5,822,940 A * 10/1998 Carlin et al. ..... 52/479
5,893,248 A * 4/1999 Beliveau ..... 52/309.7
5,966,885 A * 10/1999 Chatelain ..... 52/309.4
6,085,479 A * 7/2000 Carver ..... 52/309.8
6,256,960 B1 * 7/2001 Babcock et al. ..... 52/592.1
6,298,622 B1 * 10/2001 Cretti ..... 52/309.7
6,363,674 B1 * 4/2002 Carver ..... 52/309.8
6,408,594 B1 * 6/2002 Porter ..... 52/794.1
6,421,972 B1 * 7/2002 Dalphond et al. ..... 52/309.7
6,622,452 B2 * 9/2003 Alvaro ..... 52/742.14

* cited by examiner

*Primary Examiner*—Jeanette Chapman
(74) *Attorney, Agent, or Firm*—Boniard I. Brown

(57) ABSTRACT

Construction assemblies or modules comprising headers, wall sections and beams, are formed of end-to-end arrays of plastic foam blocks and steel studs extending above and below the foam blocks, with flanges thereof extending into the blocks. Steel studs are disposed between each pair of adjacent blocks with flanges thereof extending may be utilized for strength and durable surfaces.

25 Claims, 3 Drawing Sheets

CONSTRUCTION ASSEMBLIES

BACKGROUND AND SUMMARY OF THE INVENTION

In the construction industry, particularly with respect to house construction, there has long been a need for reduced costs of construction, shortened time period for construction, and improved insulation with minimum heat transfer between the exterior and interior of a constructed house.

The present invention provides construction assemblies or modules, improved components and improved methods for rapid construction, excellent insulation, and durability. A construction module comprises foam blocks, preferably formed of polystyrene in end-to-end array, with adjacent blocks separated by back-to-back studs secured together, as by welding, and with flanges thereof extending oppositely into the adjacent blocks. Elongate studs, preferably of steel, extend above and below the array of blocks with flanges thereof extending into the blocks.

The term "studs" with respect to steel components, is used herein because the term has long been used in the construction art to denote studs, typically of wood, which have been widely used for vertical members, etc., in building and home construction.

A construction assembly or module, typically for use as a beam, comprises a plurality of foam blocks disposed end-to-end, with elongate studs along the upper and lower surfaces of the plurality of blocks with flanges extending into the foam blocks. Between each adjacent pair of blocks are two studs secured back-to-back and extending oppositely into the adjacent blocks.

In a construction module typically for use as a wall section, the end-to-end array of blocks, longitudinally extending studs above and below the blocks with flanges extending into the blocks, are utilized. Between each pair of adjacent blocks are back-to-back studs secured together by welding with flanges extending oppositely into the adjacent blocks.

A construction module for use as a header above a door or window opening, has a first row of end-to-end blocks, and elongated studs extending along the upper and lower surfaces of the end-to-end blocks. Both studs have edge flanges extending into the blocks. A second row of end-to-end blocks is disposed normally below the first array of blocks. Elongated studs extend along the upper surfaces and the bottom surfaces of the blocks. The second or lower row of blocks may be narrower than the blocks of the upper row and a relatively narrower row of end-to-end blocks may be disposed on either side of the lower array of blocks.

The construction assemblies or modules according to the invention provides great structural strength, and excellent insulation with respect to heat transfer between the interior and exterior of a house built utilizing the modules of the invention.

The steel studs, etc., utilized according to the invention, provide substantially greater strength than structures comprised of wooden members, and have the highest strength-to-weight ratio among building materials. Outer surfaces of the construction modules, typically wall and header modules, preferably have applied thereto an adhesive coating, a matting layer applied atop the adhesive coating, and a second adhesive coating applied atop the matting. A hard, cementous coating and tough fire barriers are thus provided. The present invention enables the erection of a house in a single day, with an additional day or longer required for finish work and details. A house structure is preferably secured to a slab by appropriate metal foundation straps together with other securement arrangements.

DESCRIPTION OF THE PREFERRED EMBODIMENTS

Figure 1:
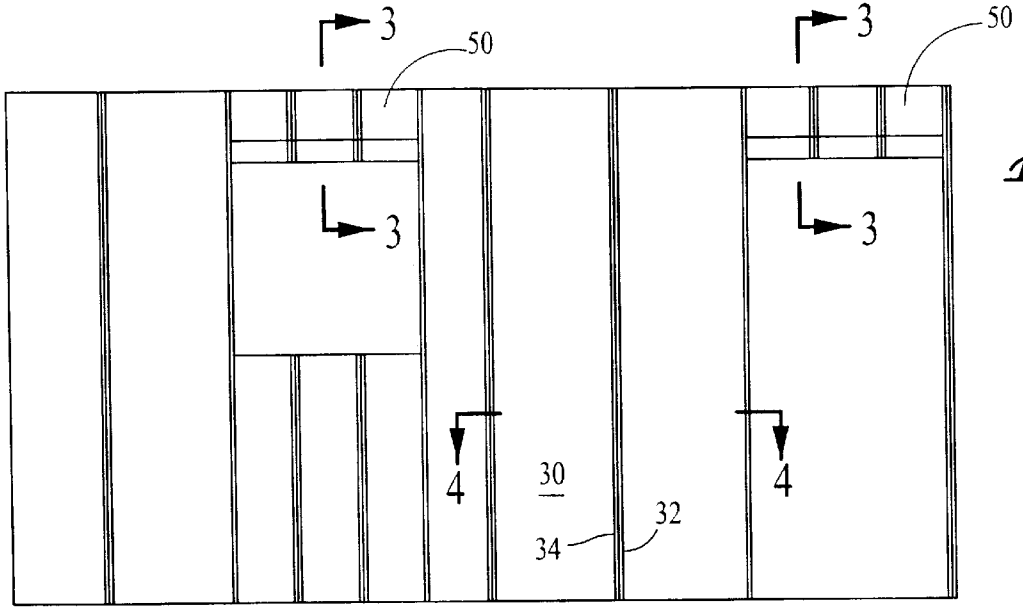
FIG. 1 is an elevational view of a house wall frame structure including vertical studs and defining a door opening and a window opening.
Figure 4:
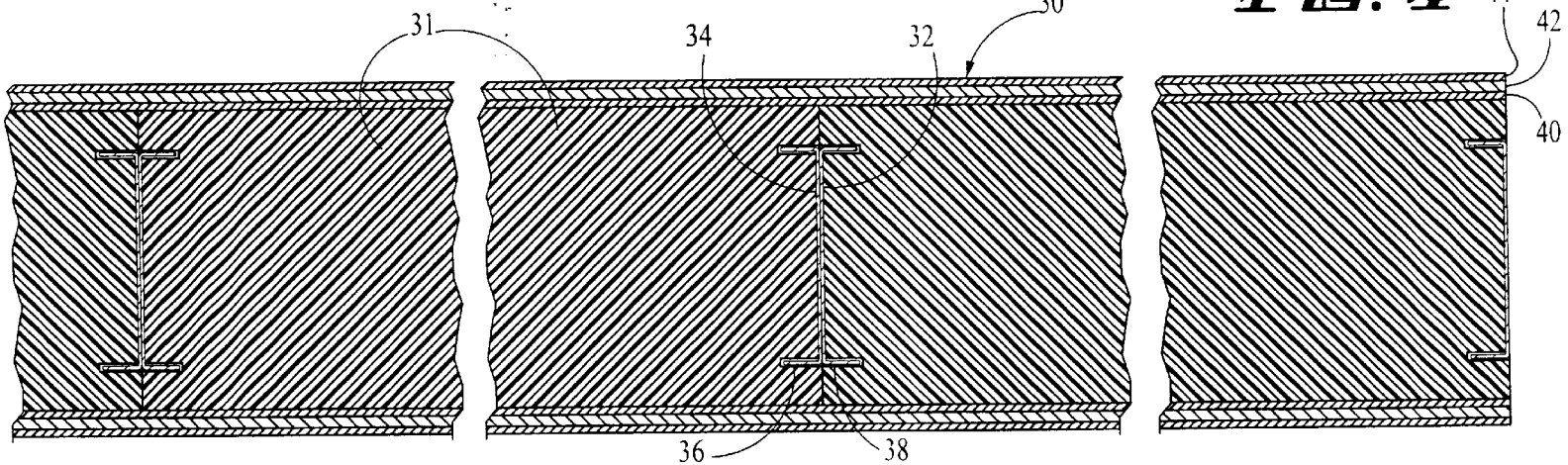
FIG. 4 is an enlarged sectional view taken at line 4—4 in FIG. 1.
Figures 2, 3:
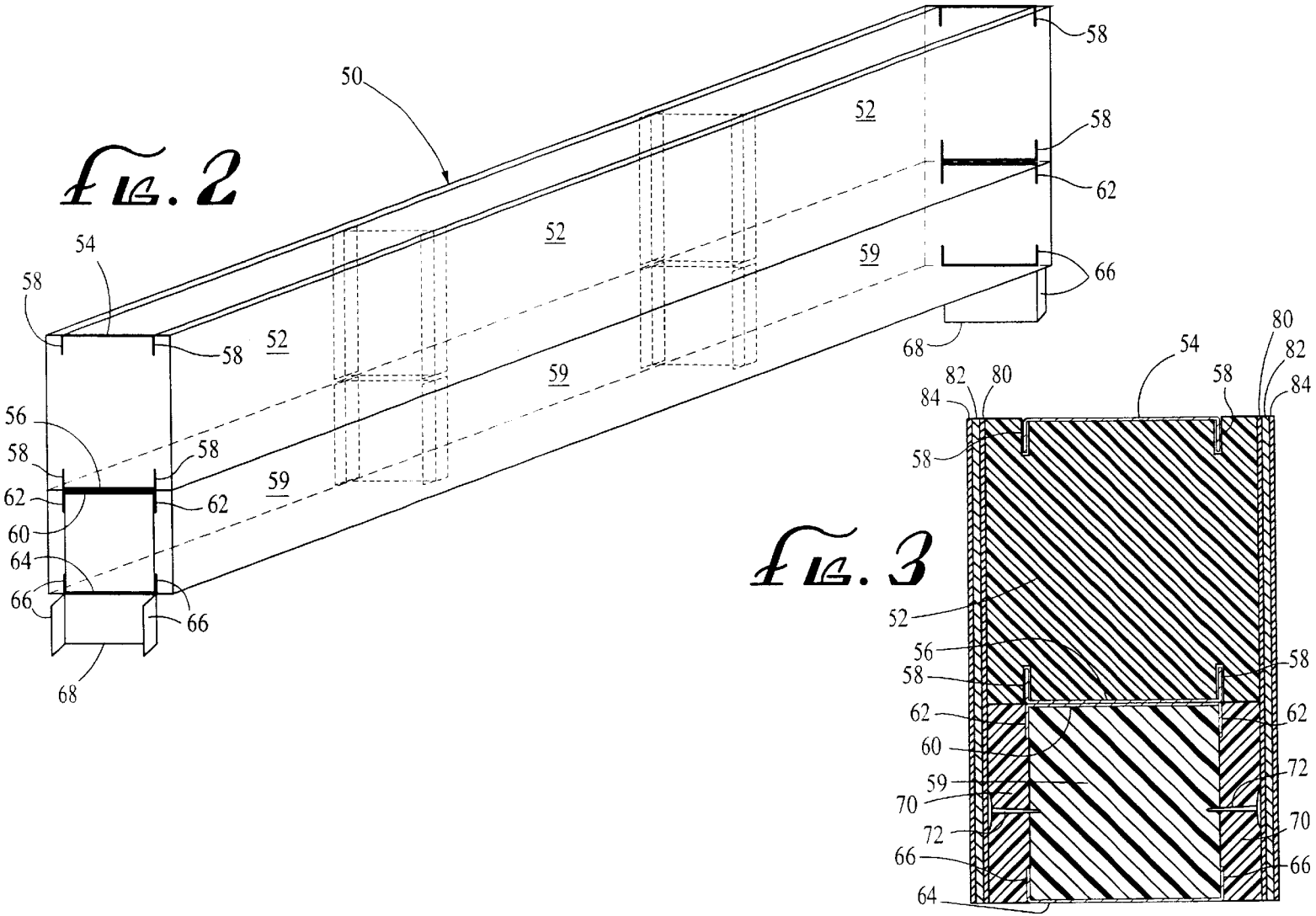
FIG. 2 is a perspective view of a construction section or module according to the invention which is adapted as a header for mounting above a door or window.
FIG. 3 is an enlarged sectional view taken at line 3—3 in FIG. 1.
Figure 5:
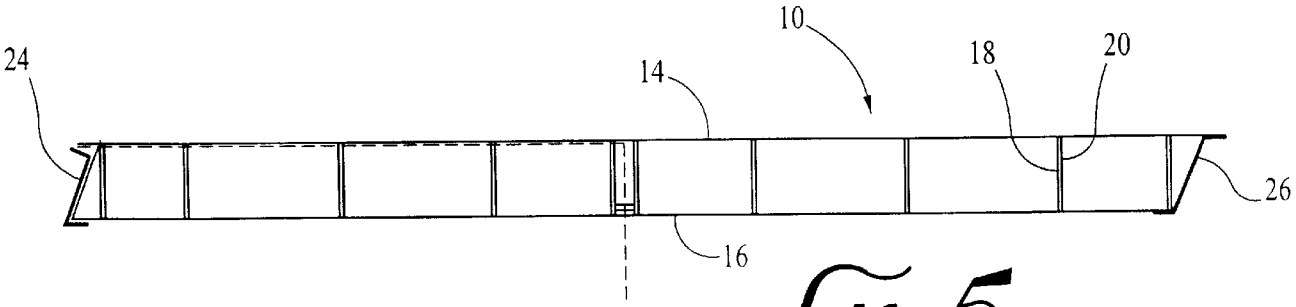
FIG. 5 is an elevational view of a construction module for use typically as a beam.
Figure 6:
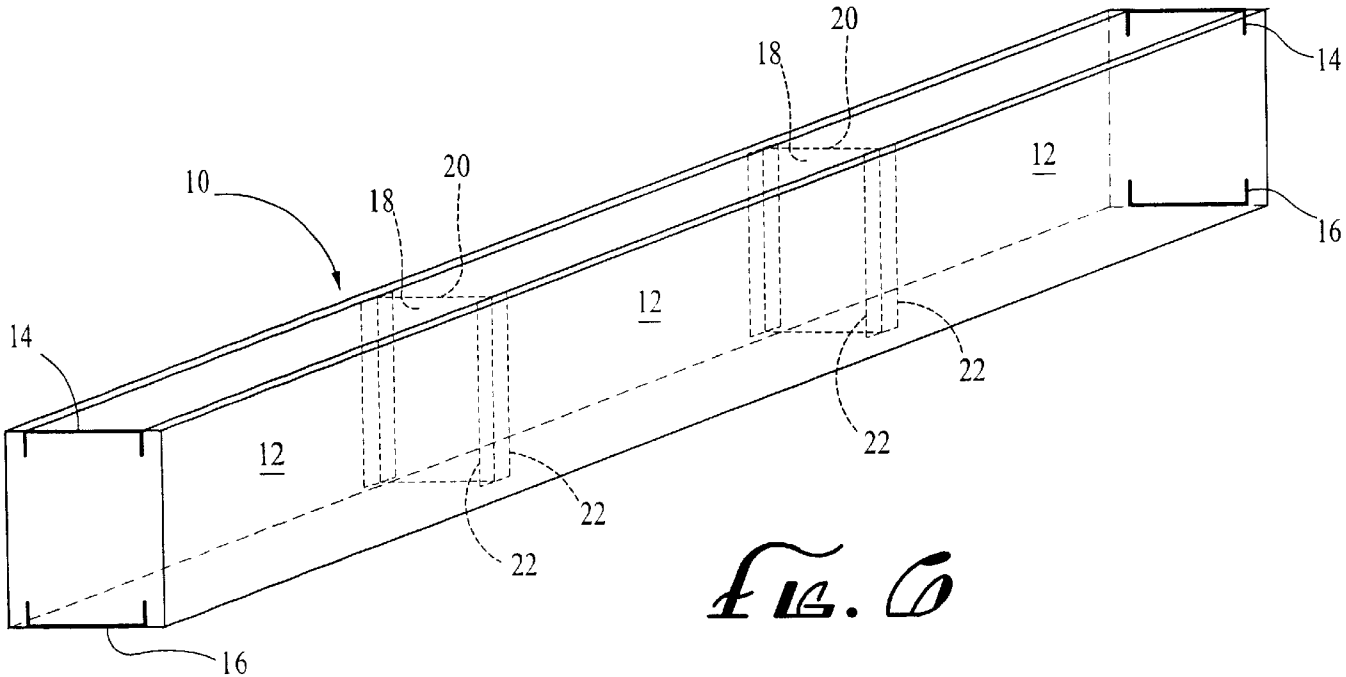
FIG. 6 is an enlarged perspective view of the construction module of FIG. 5, showing structural features thereof.

Referring to the drawings, FIGS. 1 and 3 show an embodiment of the present invention which may typically be used, as in house construction, as a header associated with doors and windows. FIGS. 4 and 1 show an embodiment of the invention which serves as a wall portion or section in such construction. FIGS. 5 and 6 illustrate an embodiment in the form of a beam.

The beam 10 of FIGS. 5 and 6 comprises a plurality of foam blocks 12 disposed in end-to-end relation, and an elongate steel stud 14 extending along the first or upper side of the foam blocks, and a second elongate stud 16 extending along a second or bottom side of the plurality of blocks, as shown.

Between each respective adjacent pair of the end-to-end foam blocks is a pair of transverse steel studs 18, 20, each having a pair of flanges therebetween, with flange portions 22 thereof extending oppositely into respective foam blocks, the flange portions being spaced inwardly from the outer side surfaces of the foam blocks, as shown. Slots are preferably cut or machined into the foam blocks to receive the flanges of the studs.

The construction module of FIGS. 5 and 6 typically serves as a beam in construction, such as in a house. Such a beam may be secured to other construction members or components as by threaded fasteners and end components 24 and 26 (FIG. 5).

Referring to FIGS. 1 and 4, wherein FIG. 4 is a sectional view taken at line 4—4 in FIG. 1, there is shown an embodiment 30 of the invention which may typically serve as a wall section. As in the embodiment of FIGS. 5 and 6, the construction module includes the plurality of foam blocks 31 disposed end-to-end with a pair of steel studs 32, 34 disposed between each adjacent pair of foam blocks, and having oppositely extending edge flanges 36, 38 extending oppositely into respective adjacent blocks. As shown, the flanges extend normally at right angles to, the flat body surfaces of the respective studs.

A layer of adhesive 40 may preferably be applied to the outer side walls of the module, and a layer of matting 42 may preferably be applied atop the adhesive. A second layer of adhesive 44 is applied. The coatings provide structural strength and strong solid surfaces.

Referring to FIGS. 1 and 3, wherein FIG. 3 is a sectional view taken at line 3—3 in FIG. 1, there is shown a construction module 50, typically utilized as a header above a door or window, as indicated in the drawings.

The construction module 50, like the earlier-described construction modules, has a plurality of foam blocks 52 with an elongate stud 54 extending along a first or upper side and a second elongate stud 56 extending along a second or lower side of the plurality of blocks.

The elongate stud 54 extends atop the end-to-end array of foam blocks 52, and a second elongate stud 56 extends along the bottom sides of the plurality of foam blocks 52, as shown. Both the upper stud 54 and the lower stud 56 have edge flanges 58 extending into the end-to-end foam blocks and spaced inwardly from the outer side surfaces of the blocks, as shown.

A second plurality of foam blocks 59 is disposed below the array of foam blocks 52. An elongate steel stud 60 extends above the lower stud array and has edge flanges 62 extending into the foam blocks 59. A lower stud 64 extends along the lower surfaces of the foam blocks, and has flanges 66 extending into the foam blocks and spaced inwardly of side surfaces of the blocks, as shown.

Both end portions 68 of the lower stud 64 are bent downwardly, as by cutting the flanges 66, thus to provide panels for securement of the header to other structural members, as by means of threaded fasteners or other means.

Relatively narrower pluralities of foam blocks 70 are mounted on respective sides of the lower array of the end-to-end foam blocks 59, as best shown in FIG. 3, and are secured to the foam blocks, preferably by threaded fasteners 72 (FIG. 3).

As with the embodiment of FIGS. 4 and 1, the construction module may preferably have on its outer surfaces a layer of adhesive 80, a layer of matting 82 disposed atop said adhesive layer, and a second layer of adhesive 84 applied atop the layer of matting, thus to provide a strong, rugged, durable structure.

It will be understood that various changes and modifications may be made from the preferred embodiments discussed above without departing from the scope of the present invention, which is established by the following claims and equivalents thereof.

What is claimed is:

1. A construction assembly comprising:

a plurality of foam blocks arrayed in end-to-end relation, an elongate stud extending along a first side and a second elongate stud extending along a second side of the plurality of blocks, each of said studs having spaced-apart flanges extending into said blocks and spaced inwardly of outer surfaces thereof, and a pair of transverse studs secured together back-to-back between each adjacent pair of blocks, said studs having respective pairs of flanges extending oppositely into the respective blocks of each adjacent pair of blocks with said flanges being disposed inwardly of the outer surfaces of the blocks.

2. A construction assembly according to claim 1, wherein said assembly comprises a beam.

3. A construction assembly according to claim 1, wherein said foam blocks are of rectilinear configuration.

4. A construction assembly according to claim 1, wherein said first side is an upper side and said second side is a lower side.

5. A construction assembly according to claim 1, wherein said studs are secured in back-to-back relation by welding.

6. A construction assembly according to claim 1, wherein said flanges extend at right angles to flat surfaces of respective studs.

7. A construction assembly according to claim 1 wherein said studs are formed of steel.

8. A construction assembly according to claim 1 wherein side surfaces of the plurality of blocks are aligned.

9. A construction module comprising:

a plurality of foam blocks arrayed in end-to-end relation, an elongate stud extending along a first side and a second elongate stud extending along a second side of the plurality of blocks, each of said studs having spaced-apart flanges extending into said blocks and spaced inwardly of outer surfaces thereof, a pair of transverse studs secured together back-to-back between each adjacent pair of blocks, said studs having respective pairs of flanges extending oppositely into the respective blocks of each adjacent pair of blocks with said flanges being disposed inwardly of the outer surfaces of the blocks, and vertical studs of a structure engaging respective end edges of said plurality of foam blocks to define a wall portion of a structure.

10. A construction module according to claim 9, wherein said module comprises a wall section.

11. A construction module according to claim 9, wherein said blocks are of rectilinear configuration.

12. A construction module according to claim 9, wherein said first side is an upper side and said second side is a lower side.

13. A construction module according to claim 9, wherein said studs are secured in back-to-back relation by welding.

14. A construction module according to claim 9, wherein said flanges are disposed at right angles to flat surfaces of the respective studs.

15. A construction module according to claim 9, wherein said studs are formed of steel.

16. A construction module according to claim 9, and further comprising a layer of adhesive on side surfaces of said foam blocks, a layer of matting disposed on said side surfaces, and a second layer of adhesive disposed on said layer of matting.

17. A construction module comprising:

a first plurality of foam blocks arrayed in end-to-end relation, an elongate stud extending along a first side and a second elongate stud extending along a second side of the first plurality of blocks, each of said studs having spaced-apart flanges extending into said blocks and spaced inwardly of outer surfaces thereof, a pair of transverse studs secured together back-to-back between each adjacent pair of said blocks, said studs having respective pairs of flanges extending oppositely into the respective blocks of each adjacent pair of blocks with said flanges being disposed inwardly of the outer surfaces of the blocks, a second plurality of foam blocks aligned in end-to-end relation and disposed below and in general alignment with said first plurality of foam blocks, an elongate stud extending above said second plurality of foam blocks and having flanges thereof extending downwardly into said blocks and spaced inwardly of outer surfaces of the blocks, and a lower stud extending along the lower side of said second plurality of blocks and having flanges extending upwardly into said blocks and spaced inwardly of outer surfaces of the blocks.

18. A construction module according to claim 17, wherein:

said lower plurality of foam blocks is narrower than said first plurality of foam blocks, said module further comprising a third plurality of blocks narrower than the blocks of the first and second pluralities of blocks, said third plurality of blocks being attached to the second plurality of blocks by fasteners, said second and third pluralities of blocks having a combined width like that of the first plurality of blocks, and an elongate lower stud extending along a lower side of said third plurality of blocks and having flanges extending into said lower plurality of blocks.

19. A construction module according to claim 17, wherein said stud extending under said third plurality of foam blocks has outer end portions thereof bent downwardly for attachment thereof to building components by fasteners.

20. A construction module according to claim 17, wherein said module comprises a header for mounting above a door or window opening.

21. A construction module according to claim 17, wherein said foam blocks are of generally rectilinear configuration.

22. A construction module according to claim 17, wherein said studs are secured in back-to-back relation by welding.

23. A construction module according to claim 17, wherein said studs are formed of steel.

24. A construction module according to claim 17, wherein side surfaces of said first and second pluralities of blocks have aligned side surfaces.

25. A construction module according to claim 17, and further comprising:

a layer of adhesive applied on side surfaces of said foam blocks, a layer of matting is disposed atop said adhesive applied to said side surfaces of the blocks, and a second layer of adhesive is disposed atop said layer of matting.

* * * * *